US005142802A

United States Patent [19]

Krause

[11] Patent Number: 5,142,802

[45] Date of Patent: Sep. 1, 1992

[54] SUPPORT FOR AN APPLIANCE, NAMELY AN IRON

[75] Inventor: Guenther Krause, Alsfeld, Fed. Rep. of Germany

[73] Assignee: Krause-Werk GmbH & Co. KG, Alsfeld, Fed. Rep. of Germany

[21] Appl. No.: 645,989

[22] Filed: Jan. 24, 1991

[30] Foreign Application Priority Data

Jan. 25, 1990 [DE] Fed. Rep. of Germany ... 9000832[U]

[51] Int. Cl.[5] ..... D06F 81/10

[52] U.S. Cl. ..... 38/107; 38/106; 38/142; D32/66; D32/73

[58] Field of Search ..... 38/106, 107, 111, 142; 108/28, 29, 121; 219/245-247; 248/117.1, 117.2, 117.7; D32/66, 68, 73

[56] References Cited

U.S. PATENT DOCUMENTS

| | | | |
|---|---|---|---|
| D. 211,603 | 7/1968 | Wilson et al. | D32/73 |
| 1,930,063 | 10/1933 | Schlesinger | 38/111 |
| 2,941,320 | 6/1960 | Caddel | 38/106 X |
| 3,212,742 | 10/1965 | Pavoni | D32/73 X |
| 3,435,957 | 4/1969 | Lloyd | 38/106 X |
| 3,698,110 | 10/1972 | Shettel | 38/107 |
| 4,154,010 | 5/1979 | Evans | 38/106 |
| 4,910,896 | 3/1990 | Ruschitzka | 38/107 X |

FOREIGN PATENT DOCUMENTS

| | | | |
|---|---|---|---|
| 0228953 | 11/1959 | Australia | 248/117.7 |
| 0131385 | 4/1951 | Sweden | 38/107 |
| 0623648 | 5/1949 | United Kingdom | 38/107 |
| 1557206 | 12/1979 | United Kingdom | 38/107 |
| 2072711 | 10/1981 | United Kingdom | 38/107 |
| 9000642 | 1/1990 | World Int. Prop. O. | 38/107 |

*Primary Examiner*—Werner H. Schroeder
*Assistant Examiner*—Ismael Izaguirre
*Attorney, Agent, or Firm*—Flynn, Thiel, Boutell & Tanis

[57] ABSTRACT

A support for an appliance, namely an iron. The support is fastened to an ironing board and includes a closed frame with a center recess. The frame is symmetrical with respect to a vertical center plane through the center of the ironing board. At least one adjustable support grid for an iron is arranged in the center recess. The frame has mounting devices thereon for mounting additional parts.

16 Claims, 9 Drawing Sheets

Fig.8
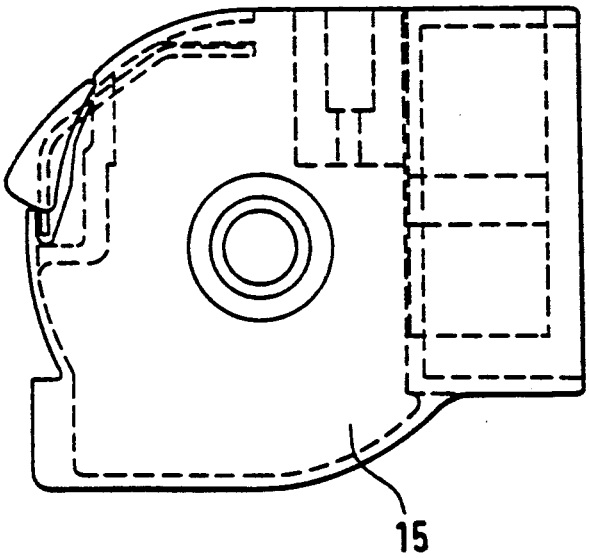
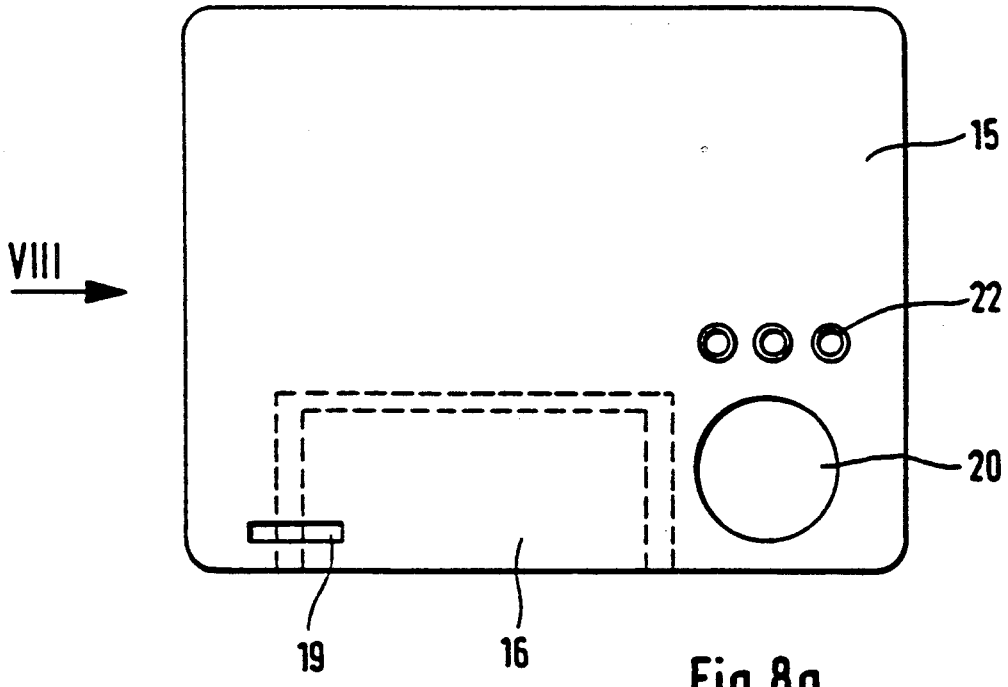
Fig.8a

Fig. 9
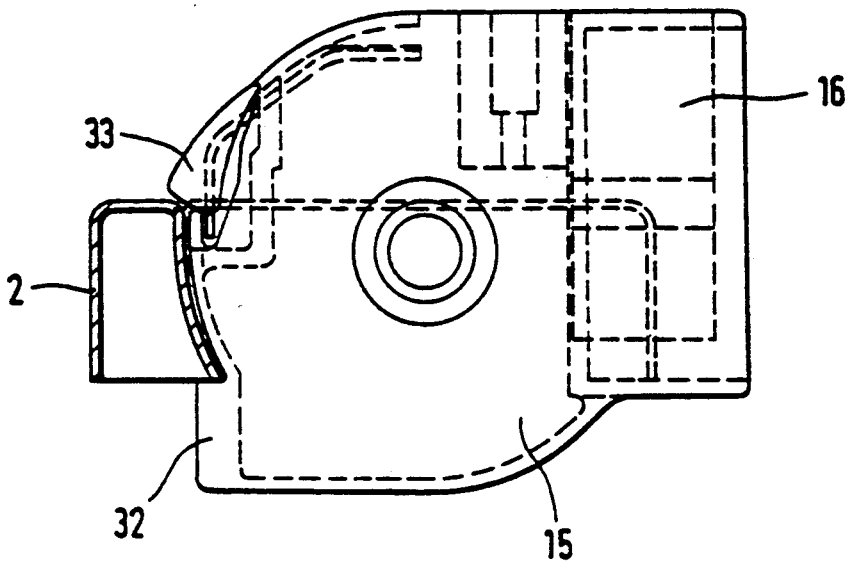
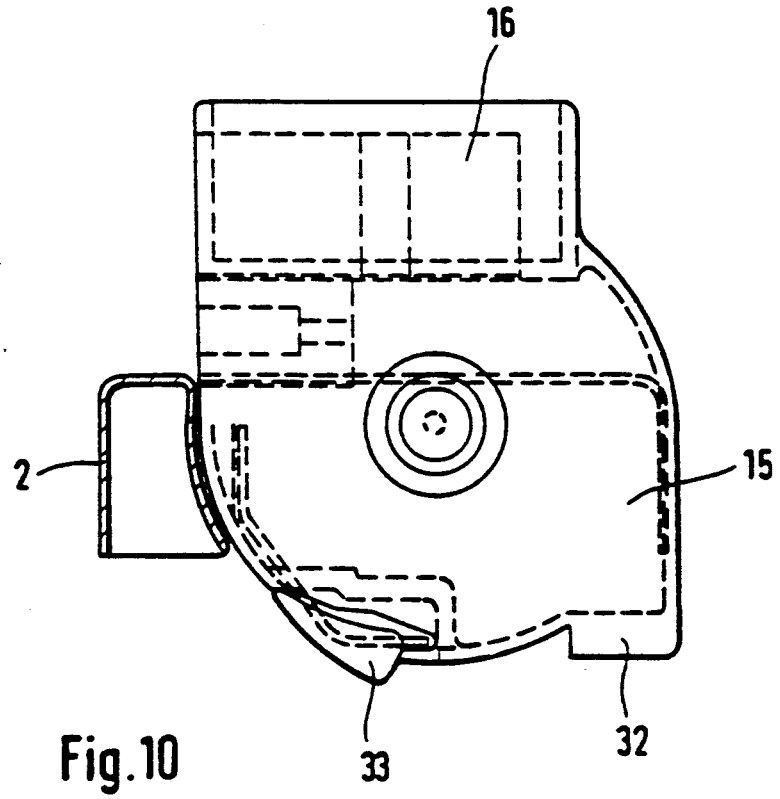
Fig. 10

SUPPORT FOR AN APPLIANCE, NAMELY AN IRON

FIELD OF THE INVENTION

The invention relates to a support for an appliance, namely an iron, which support can be fastened to an ironing board.

BACKGROUND OF THE INVENTION

Ironing boards of many different designs have been known for a long time. They usually consist of an ironing board which can be set up by means of two table legs pivotal against one another and can be stored space-savingly in a collapsed condition when not in use.

In order to be able to offer a complete work station to the operator, it is furthermore known to fasten a support to one end of the ironing board, on which support the iron can be set up or stored. Such supports are usually designed as substantially platelike elements, on which the iron can be stored, sometimes having edges in order to prevent the iron from sliding off.

The disadvantage of the known ironing boards is that these offer little help to the operator when having to iron larger amounts of clothing without any further appliances. There exists, in particular, always the danger that the operator gets caught on the cord of the iron and pulls it down from the ironing table. Furthermore, steam irons cannot be placed onto the known supports since the steam irons must be positioned inclined or sloped in order to assure a return of the water into the water container. A further disadvantage is that further auxiliary means, as for example support tables, clothes support racks or the like must be used in order to complete the work, station.

SUMMARY OF THE INVENTION

The basic purpose of the invention is to provide a support for storing an iron, which support can be fastened to an ironing board and which has a simple design and can be manufactured inexpensively and is reliable in its operation and serves the purpose of creating a complete work station.

The purpose is attained according to the invention by a closed frame having a center recess, which frame is symmetrical with respect to a vertical center plane, and in which recess is ,arranged at least one adjustable support grid for mounting an iron and which frame has mounting means for additional parts.

The support of the invention has a number of significant advantages. Since according to the invention a closed frame is provided, there exists the possibility to fasten additional parts to the frame as this will be described in detail hereinafter. Thus, it is possible in a particularly favorable, simple manner to have a fully equipped work station without requiring additional furniture or like items. The particular advantage is that the frame can be completed as desired with the additional parts so that the entire ironing table is suited both for right-handed and also left-handed persons. Depending on the needs of the operator, the additional parts can be arranged on the frame. Since the frame has furthermore the center recess, in which the support grid is arranged, there does not exist the danger of damaging the frame with the hot iron. Thus, the frame can also be made of a plastic. A further advantage of the center recess can be seen in the support grid being able to be designed adjustably so that same can be moved from a horizontal position for the support of a common iron into an inclined or swivelled position for the support of a steam iron. The support thus can be adapted universally to the respective demands without requiring complicated change-overs.

A particularly favorable design of the invention provides that the support grid is designed with two support rods which can be pivoted each about a horizontal axis, which axis is parallel to the center plane, from a horizontal into an inclined position. The use of two support rods makes it possible to use the support for a right-handed and also for a left-handed person since in each case it is possible to choose the desired sloped position for the iron. This is particularly advantageous in view of the very large number of left-handed people since, on the one hand, this group of people are not being disadvantaged and, on the other hand, it is not necessary to provide different ironing boards.

In order to guarantee a safe placement of a steam iron, it is furthermore provided that the lateral inner edges of the recess are sloped. In order to furthermore assure a sturdy support of the iron, it is provided that a stop exists on the recess of the frame, which stop is used to substantially perpendicularly align the support rod with respect to the slope in the inclined position of the support rod. As an alternative, it is also possible to provide a stop on the support bar itself, which stop abuts for example the underside of the frame.

To fasten the frame on the ironing board, it is provided that the frame has two bars which are parallel to one another and which can engage profiled rails on the ironing board. It is thereby particularly advantageous when the bars have plates on the oppositely lying sides, which plates can be moved into the profiled rail and/or the pivot axis of a table leg. Since an ironing board is usually equipped with profiled rails, in which the upper ends of a second table leg can slide when the ironing board is collapsed, the profiled rails have already a sufficient strength which can be utilized to anchor the iron support on the table. It is advantageous for the described possibility with the two bars and the plates that the function of the ironing table is not influenced and that no additional fastening means, as for example screws or the like must be used, which may possibly reach to the surface of the ironing table and can damage the clothing to be ironed.

The frame is in a particularly advantageous development of the invention designed substantially rectangularly, this design eases, on the one hand, the manufacture of the frame, on the other hand, the attachment of the additional parts.

It is furthermore particularly advantageous according to the invention when the frame has on the side not facing the ironing board a center recess for receiving a connecting element. The connecting element can be equipped for example with a socket and a current-supplying line so that the cord of the iron can be plugged into the socket. No additional extension cord or the like is needed, which could get caught and possibly influence a smooth ironing process. It is furthermore advantageous when the connecting element is equipped with means for fastening a cord holder, into which the cord of the iron can be suspended. It is thus prevented that the iron when stored on the support rods comes into contact with the electric cord and damages same.

Furthermore, the connecting element can be used according to the invention to support a lamp console with a lamp to illuminate the work station. It is thereby preferably provided that the electric connecting means, namely suitable plug contacts, are also provided on the connecting element.

A shirt hanger holder can for example be supported on the lamp console for hanging shirts hangers thereon. It is then not necessary to use additional hanger means separately from the ironing board.

The frame can according to the invention also be used to carry a substantially platelike clothes support rack, onto which at least a portion of the ironed clothes can be placed. In order to design the ironing board suitably both for the right-handed and also for the left-handed person, the clothes support rack can be fastened on both sides of the frame to the frame. The fastening is preferably accomplished by a bolt or pin of the clothes support rack being placed into a center recess on the side of the frame, which side does not face the ironing board. In addition, further form-closed fastening means, for example stops or the like, can be provided.

Thus, the invention has created the possibility to completely equip an ironing work station, independent from whether the operator is a right-handed or a left-handed person, thereby providing a modular design opening up the possibility to attach additional, further parts to the frame. According to the invention, further possibilities result in addition to the so far discuqsed additional parts.

BRIEF DESCRIPTION OF THE DRAWING

The invention will be described hereinafter in connection with one exemplary embodiment and the drawings, in which:

FIG. 9 is a side view of the connecting element in the installed state and ready for use, FIG. 10 is a side view, similar to FIG. 9, in which the connecting element is in a swivelled position.

DETAILED DESCRIPTION

Figure 1:
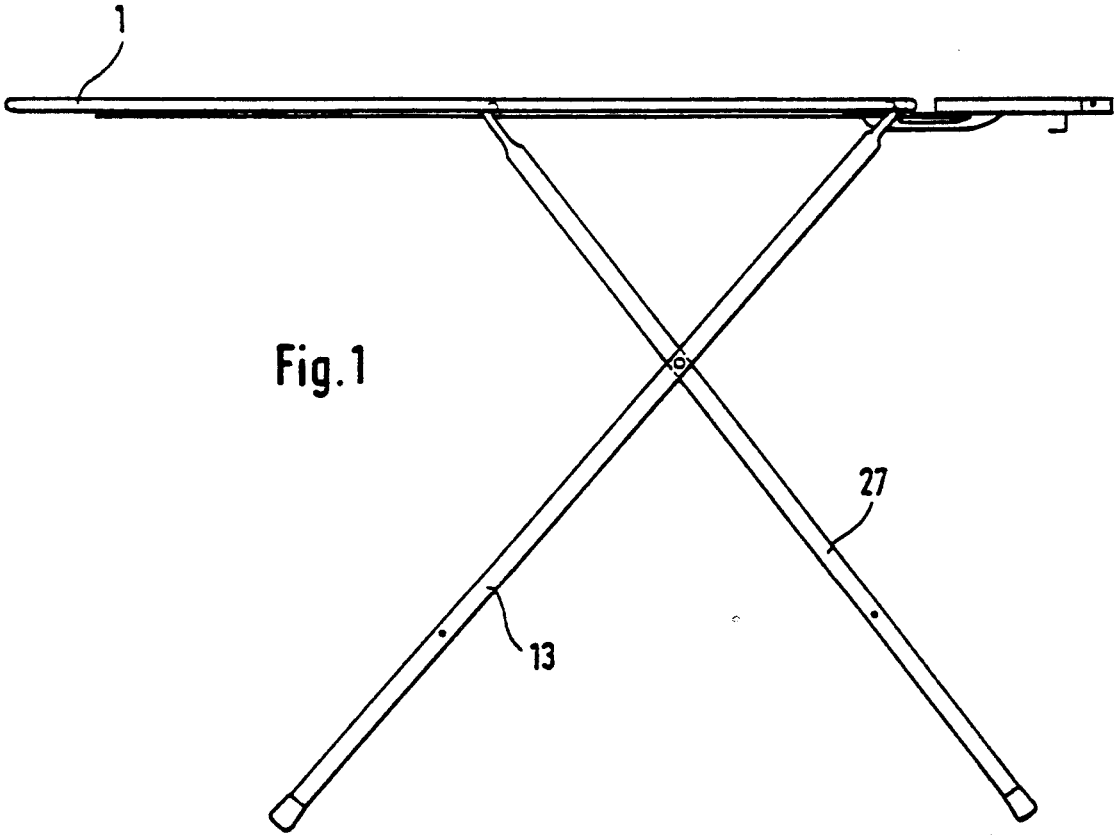
FIG. 1 is a schematic side view of an exemplary embodiment of the ironing board embodying the invention.
Figure 2:
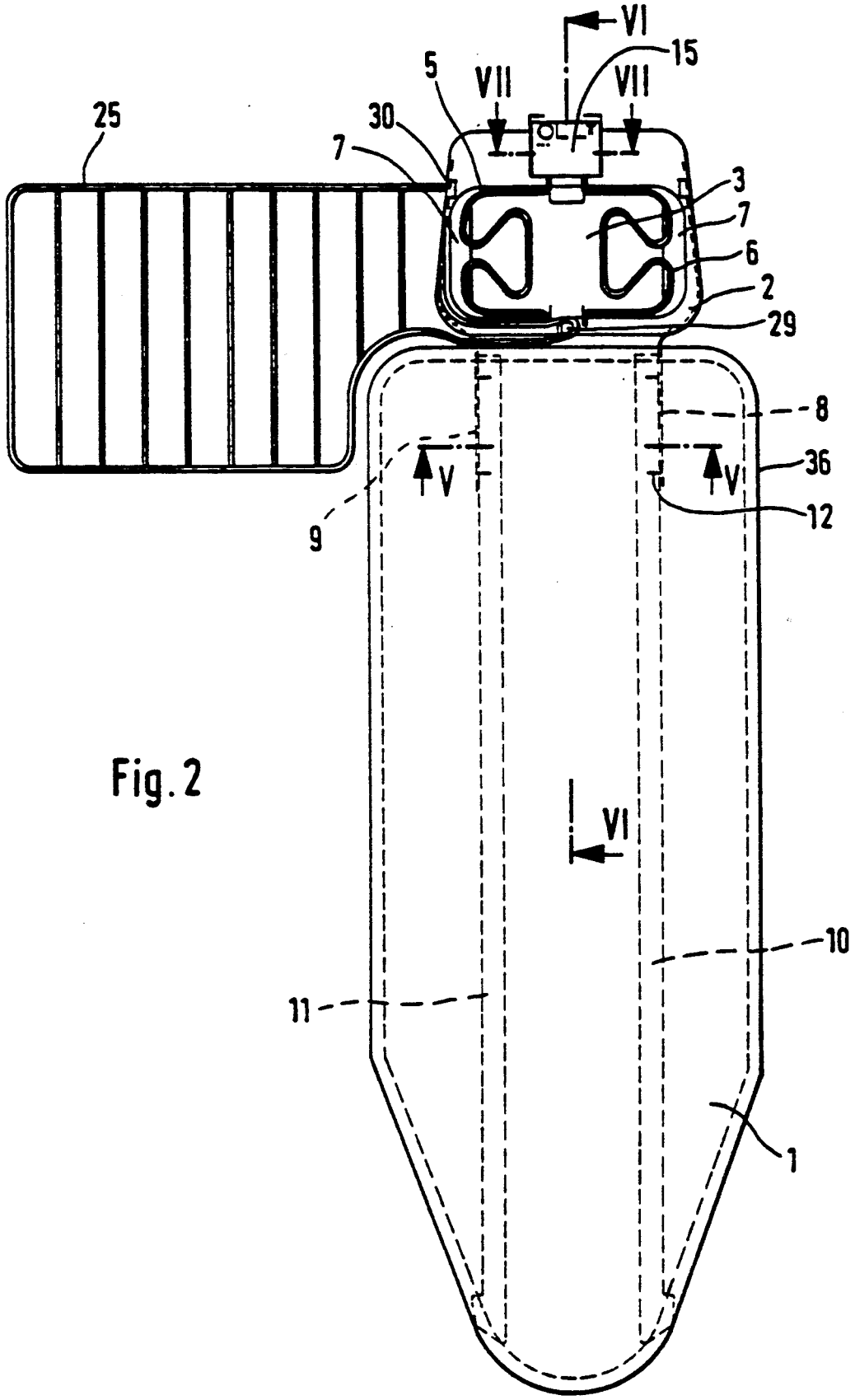
FIG. 2 is a top view of the ironing board illustrated in FIG. 1.

One exemplary embodiment of the ironing board of the invention is illustrated in the side view in FIGS. 1 and 2. The board includes a table leg 13 pivotally supported on profiled rails 10, 11 of the ironing board, and a further table leg 27 pivotally connected to the table leg 13 and movably guided with its upper end in the profiled rails 10, 11. The locking means for the table leg 27 are not shown since they, just like the basic design of the profiled rails 10, 11, are part of the state of the art. The ironing board 1 has furthermore a suitable upper platelike cover, for example a sheet-metal plate. This has also not been illustrated separately in the drawings, since this is also part of the state of the art.

Figure 5:
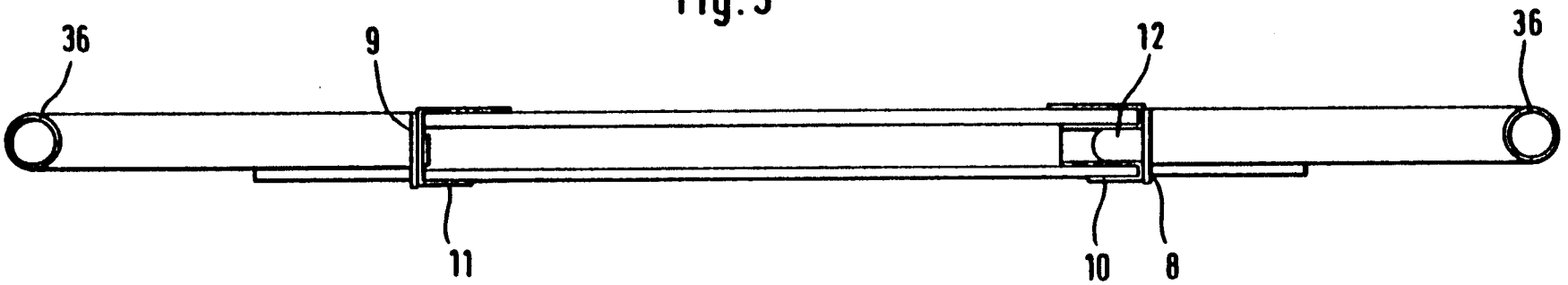
FIG. 5 is a cross-sectional view taken along the line V—V of FIG. 2.
Figure 6:
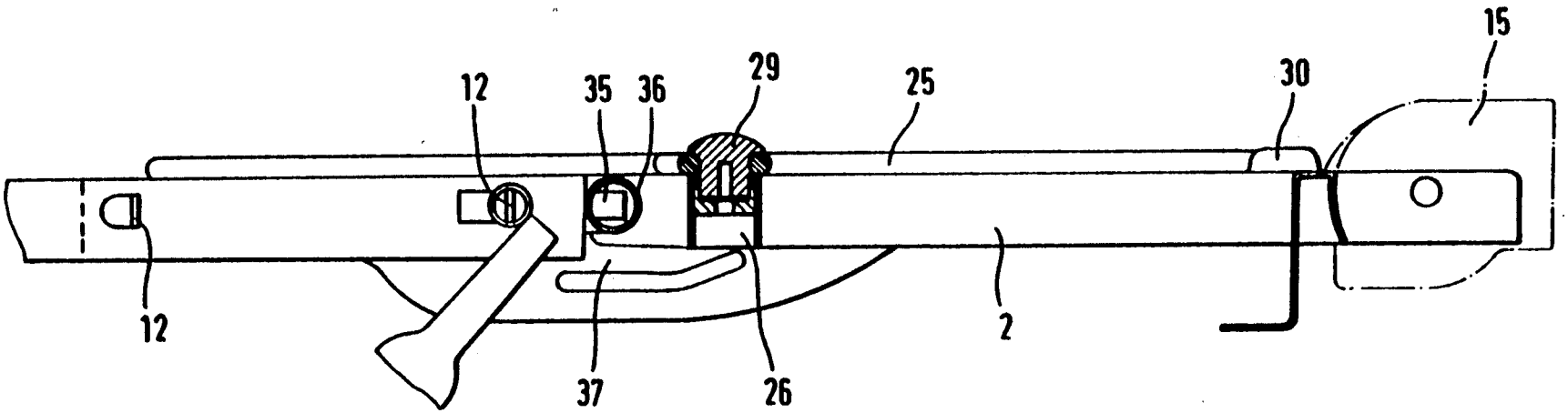
FIG. 6 is a cross-sectional view taken along the line VI—VI of FIG. 2.

A frame 2 is according to the invention arranged at the rear end of the ironing board 1. This frame, as can be particularly seen in FIG. 3, has a center recess 3 and laterally projecting bars 8, 9, on the inner sides of which tabs 12 are provided. The bars 8, 9 can, as this is shown in FIG. 5, be mounted on the profiled rails 10, 11. The tabs 12 can either be placed into the pivot axis of the table leg 13 or through suitable recesses in the profiled rails 10, 11 and can, if necessary, be bent. Two plates 35 directed toward the frame 2 are formed on the part 37 of the bars 8, 9. The plates 35 extend into slots in the reinforcing pipe 36 of the ironing board 1. The frame 2 is in this manner fastened torsion free on the ironing board 1.

Figure 4:
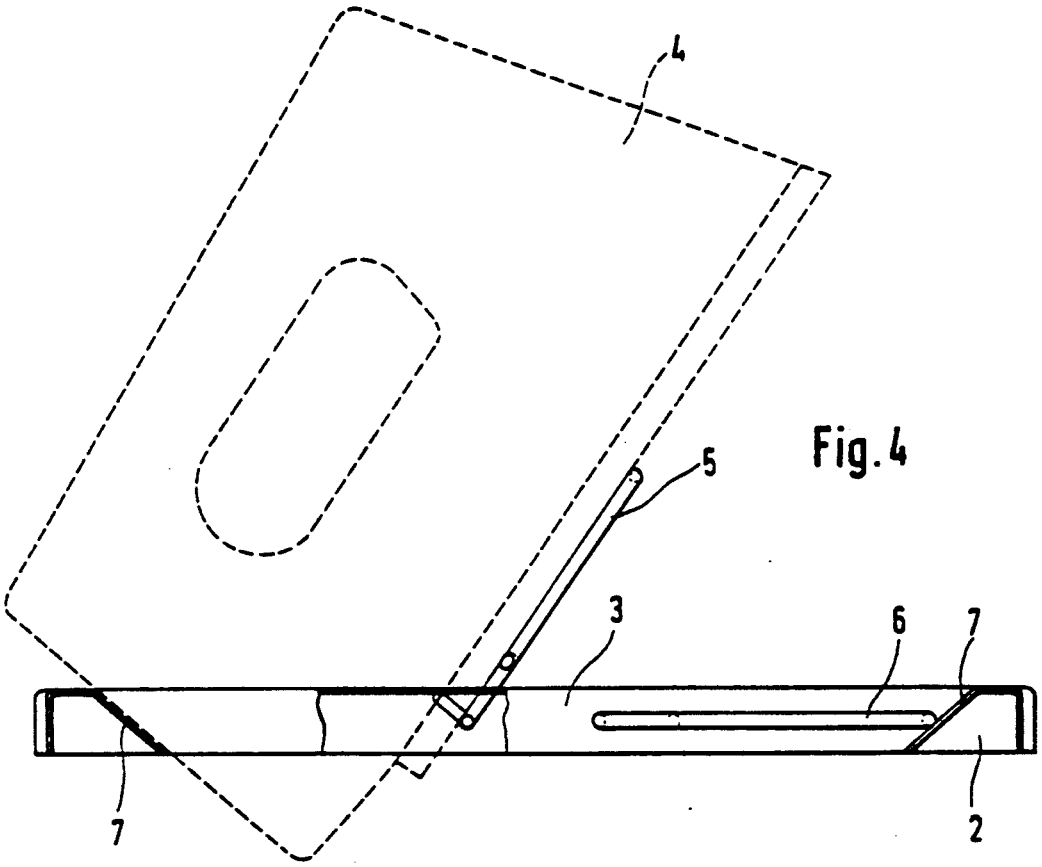
FIG. 4 is a cross-sectional view taken along the line IV—IV of FIG. 3.

Two support rods 5, 6 are supported in the area of the center recess of the frame 2, which support rods 5, 6 are each pivotal about a horizontal axis. The bent or angled free ends of the support rods 5, 6 are for this purpose guided in recesses of the frame 2, as this can be seen in FIG. 2. FIG. 4 shows for clarification purposes in the side view one of the support rods 6 in the horizontal position, while the second support rod 5 is moved into an inclined position so that a steam iron 4 can be placed onto the frame 2. In order to guarantee a safe support of the steam iron 4, a slope 7 exists on each of the two oppositely lying inner sides of the frame 2, which slope 7 is arranged substantially perpendicular with respect to the inclined position of the support rod 5. Furthermore, it is possible to provide suitable stops or similar means in order to hold the support rod 5 in the swivelled position.

Figure 3:
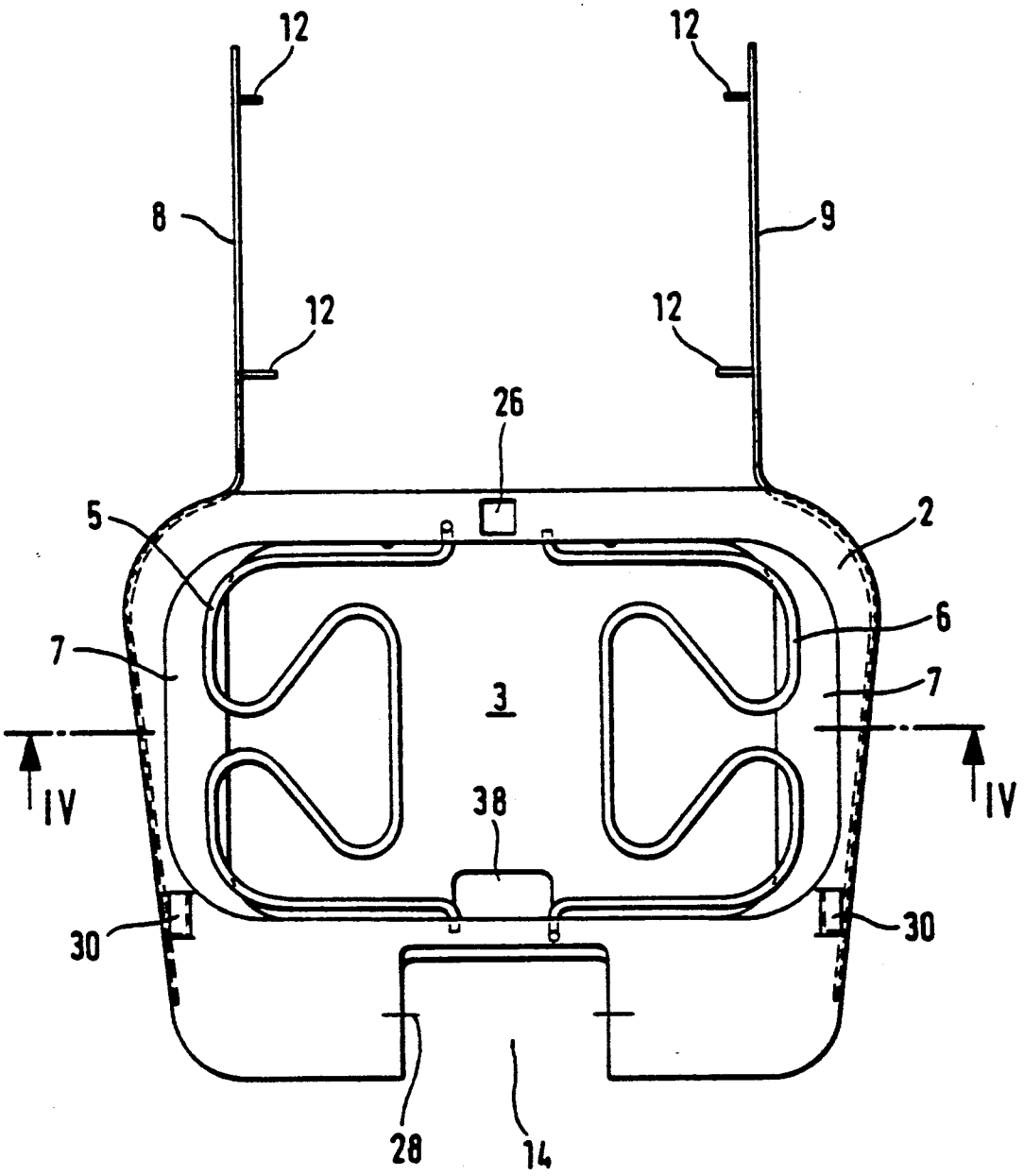
FIG. 3 is an enlarged view of the support of the invention for storing the iron.

FIGS. 2 and 3 show furthermore that the frame 2 is symmetrically designed with respect to a vertical center plane so that the ironing board can be used both by right-handed and also left-handed persons.

Figure 7:
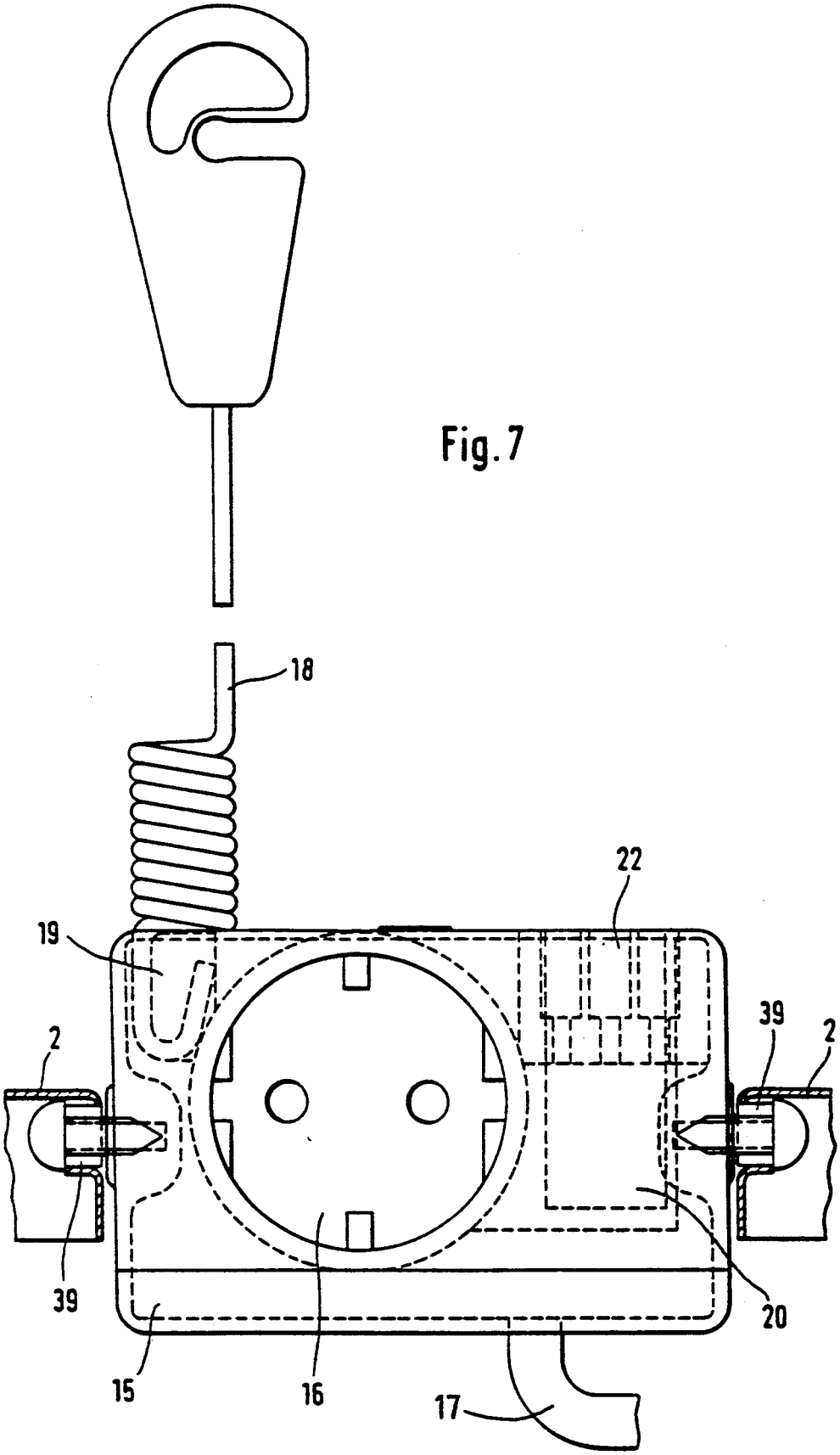
FIG. 7 is a side view, partially in cross section, taken along the line VII—VII of FIG. 2, FIGS. 8 and 8a are a side view and a top view of the connecting element illustrated in FIG. 7.

As can particularly be seen in FIG. 3, the frame 2 has several mounting means to add additional equipment. Thus, a recess 14 exists for example in the center area of the frame 2, which area does not face the ironing board. A connecting element 15, which will be described in detail in connection with FIGS. 6 to 10, can be inserted into the recess 14. The connecting element is pivotal 90 about a horizontal axis 28 defined (by axle journals 39 (FIG. 7) in particular to avoid damage to the connecting element 15 during storing of the collapsed ironing board 1.

The ironing board can furthermore be equipped with a clothes support rack 25, which can be placed into a center recess 26 of the frame (see FIG. 3). The clothes support rack 25 is secured to the frame by a bolt 29. Stops 30 are furthermore each constructed on the sides of the frame 2, against which stops 30 the clothes support rack 25 is supported. The clothes support rack 25 is designed like a grid and can be suspended on either side of the ironing board 1 as this can be seen in the illustration of FIG. 2.

The connecting element 15 has, as this is particularly noticeable in FIGS. 7 to 10, a socket 16, to which electric energy can be supplied through a line 17. The cable of the iron can be plugged into the socket 16. Furthermore, means 20 to support a lamp console 21 exist on the connecting element 15. The means 20 include a recess and additional connecting means 22 in the form of electric plug connections, into which the electric contacts of the connecting cable 31 can be plugged so that a lamp 23 supported on the lamp console 21 can be supplied with current.

A recess 19 exists furthermore on the connecting element, into which recess a cable holder 18 can be placed. The cable holder 18 has a spiral spring and is designed hook-shaped at its lower end and has an upper fastening recess, in which the cable of the iron can be suspended. This design assures a sufficient stability, on the other hand the cable holder 18 can deform upon a suitable tensile load.

FIGS. 9 and 10 show two different operating conditions of the connecting element. In FIG. 9 it is locked in a swivelled position, in which a nose 32 rests against the underside of the frame 2. Locking is done through a lock 33, which is pivotal against the action of an elastic element and in the operating condition grips over the upper side of the frame 2. FIG. 10 shows a condition in which the connecting element is moved into a swivelled state, in which the ironing board 1 can be stored in folded condition so that damage to the socket 16 is prevented.

Figures 11, 12:
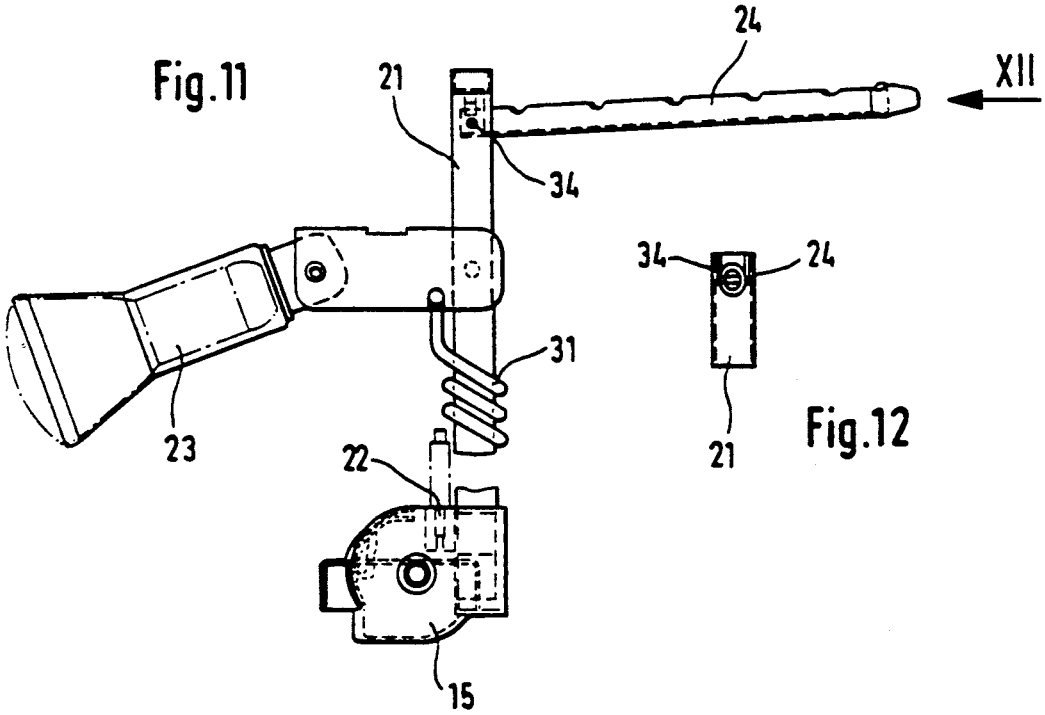
FIG. 11 is a partial side view of the connecting element with a lamp and a lamp console.
FIG. 12 is a front view corresponding with the viewing direction XII of FIG. 11 of the shirt hanger holder illustrated in FIG. 11.

FIGS. 11 and 12 illustrate details of the lamp console 21. Same is designed substantially rod-shaped and can be placed into the recess 20. The lamp console 21 carries at its upper end a shirt hanger holder 24 which, as shown in FIG. 12, has a pipe-shaped cross section and is rotatable about a pivot axis 34. Thus, it is possible to move the shirt hanger holder 24, for storing the ironing board, into a position in which it is in alignment with the lamp console 21.

The above description shows that the accessories can be fastened on or removed from the frame 2 or rather the socket in a simple manner so that no difficulties at all result when storing the ironing board.

The embodiments of the invention in which an exclusive property or privilege is claimed are defined as follows:

1. A support for an iron, said support being fastened to an ironing board and comprising:

a closed frame with a center recess, said frame being symmetrical with respect to a vertical center plane, said recess having mounted therein at least one adjustable support grid for supporting the iron, said frame having mounting means for facilitating a mounting of additional devices incidental to ironing, said support grid being formed by two support rods, each of which are pivotal about a horizontal axis, which is parallel with respect to the center plane, from a horizontal into an inclined position.

2. The support according to claim 1, wherein the recess has lateral inner edges, and said edges are sloped.

3. The support according to claim 2, including a stop on the recess to facilitate a substantially perpendicular alignment of each inclined support rod with respect to a proximate slope of said edges.

4. The support according to claim 1, wherein the frame is substantially rectangularly shaped.

5. A support for an iron, said support being fastened to an ironing board and comprising:

a closed frame with a center recess, said frame being symmetrical with respect to a vertical center plane, said recess having mounted therein at least one adjustable support grid for supporting the iron, said frame having mounting means for facilitating a mounting of additional devices incidental to ironing, said frame having two bars extending parallel to one another and engaging profiled rails of the ironing board.

6. The support according to claim 5, wherein the bars have tabs on oppositely lying sides, said tabs being moved into the profiled rails.

7. A support for an iron, said support being fastened to an ironing board and comprising:

a closed frame with a center recess, said frame being symmetrical with respect to a vertical center plane, said recess having mounted therein at least one adjustable support grid for supporting the iron, said frame having mounting means for facilitating a mounting of additional devices incidental to ironing, said mounting means including on a side remote from the ironing board a second center recess adapted to receive an additional device, said additional device being a connecting element, said connecting element being received in said second center recess, said connecting element having axle journals engaging journal recesses in said frame.

8. The support according to claim 7, wherein the connecting element has a socket and a current-supply line.

9. The support according to claim 7, wherein the connecting element is equipped with means for fastening a cable holder.

10. The support according to claim 7, wherein the connecting element has means to support a lamp console and has electric connection means for the lamp.

11. The support according to claim 10, wherein a shirt hanger holder is supported on the lamp console.

12. The support according to claim 7, wherein the connecting element is pivotal to 90°.

13. A support for an iron, said support being fastened to an ironing board and comprising:

a closed frame with a center recess, said frame being symmetrical with respect to a vertical center plane, said recess having mounted therein at least one adjustable support grid for supporting the iron, said frame having mounting means for facilitating a mounting of additional devices incidental to ironing, and a substantially platelike clothes support rack, said support rack being fastenable to the sides of the frame.

14. The support according to claim 13, wherein the clothes support rack is secured to the frame by a bolt inserted into a third center recess on the ironing board on the side of the frame facing the ironing board.

15. The support according to claim 14, wherein one end of the clothes support rack is supported by a stop on the frame.

16. A support for an iron, said support being fastened to an ironing board and comprising:

a closed frame with a center recess, said frame being symmetrical with respect to a vertical center plane, said recess having mounted therein at least one adjustable support grid for supporting the iron, said frame having mounting means for facilitating a mounting of additional devices incidental to ironing, a connecting element mounted on said mounting means and a spring-loaded lock mounted on the connecting element for locking the connecting element in an operating position on the frame.

* * * * *

UNITED STATES PATENT AND TRADEMARK OFFICE

CERTIFICATE OF CORRECTION

PATENT NO. : 5 142 802

DATED : September 1, 1992

INVENTOR(S) : Guenther KRAUSE

It is certified that error appears in the above-identified patent and that said Letters Patent is hereby corrected as shown below:

Column 6, line 7; after "rails" insert
---and engaged therewith---.

Signed and Sealed this

Ninth Day of November, 1993

*Attest:*

*Attesting Officer*

Bruce Lehman

BRUCE LEHMAN

*Commissioner of Patents and Trademarks*